US009156129B2

(12) United States Patent
Yoritsune et al.

(10) Patent No.: US 9,156,129 B2
(45) Date of Patent: Oct. 13, 2015

(54) GRINDING MACHINE AND GRINDING METHOD

(71) Applicant: JTEKT Corporation, Osaka-shi (JP)

(72) Inventors: Masashi Yoritsune, Anjo (JP); Makoto Tano, Obu (JP)

(73) Assignee: JTEKT CORPORATION, Osaka-shi (JP)

( * ) Notice: Subject to any disclaimer, the term of this patent is extended or adjusted under 35 U.S.C. 154(b) by 0 days.

(21) Appl. No.: 14/185,043

(22) Filed: Feb. 20, 2014

(65) Prior Publication Data

US 2014/0242882 A1 Aug. 28, 2014

(30) Foreign Application Priority Data

Feb. 26, 2013 (JP) ..... 2013-035348

(51) Int. Cl.

| | |
|---|---|
| ***B24B 49/00*** | (2012.01) |
| ***B24B 51/00*** | (2006.01) |
| ***B24B 49/04*** | (2006.01) |
| ***B24B 5/42*** | (2006.01) |

(52) U.S. Cl.

CPC . *B24B 51/00* (2013.01); *B24B 5/42* (2013.01); *B24B 49/04* (2013.01)

(58) Field of Classification Search

CPC ..... B24B 49/16; B24B 37/03; B24B 37/042; B24B 49/12; B24B 49/00

USPC ..... 451/5, 6, 49, 57, 58, 251, 181

See application file for complete search history.

(56) References Cited

U.S. PATENT DOCUMENTS

| | | | | |
|---|---|---|---|---|
| 4,663,892 | A * | 5/1987 | Smith | 451/49 |
| 6,729,936 | B1 * | 5/2004 | Hori et al. | 451/8 |
| 6,733,364 | B2 * | 5/2004 | Griffiths | 451/5 |
| 7,809,463 | B2 * | 10/2010 | Yonezu et al. | 700/190 |
| 7,815,493 | B2 * | 10/2010 | Pflager et al. | 451/181 |
| 7,818,080 | B2 * | 10/2010 | Yonezu et al. | 700/95 |
| 2002/0155790 | A1 * | 10/2002 | Ido et al. | 451/9 |

FOREIGN PATENT DOCUMENTS

| | | |
|---|---|---|
| JP | 11-90800 | 4/1999 |
| JP | 2000-107902 | 4/2000 |
| JP | 2000-218479 | 8/2000 |

* cited by examiner

*Primary Examiner* — George Nguyen

(74) *Attorney, Agent, or Firm* — Oblon, McClelland, Maier & Neustadt, L.L.P.

(57) ABSTRACT

There are provided a grinding machine and a grinding method that make it possible to achieve a high degree of accuracy of the roundness of a workpiece. As at least one of a coolant dynamic pressure and a grinding efficiency varies depending on a phase of the workpiece, a pressing force in the cut-in direction, which an eccentric cylindrical portion of the workpiece receives from a grinding wheel, varies and a degree of deflection of the eccentric cylindrical portion also varies. In the grinding machine, the degree of deflection during grinding is acquired based on the coolant dynamic pressure and the grinding efficiency, a first correction value for a command position of the grinding wheel relative to the eccentric cylindrical portion is computed, and the command position is corrected based on the first correction value.

7 Claims, 10 Drawing Sheets

GRINDING MACHINE AND GRINDING METHOD

INCORPORATION BY REFERENCE

The disclosure of Japanese Patent Application No. 2013-035348 filed on Feb. 26, 2013 including the specification, drawings and abstract, is incorporated herein by reference in its entirety.

BACKGROUND OF THE INVENTION

1. Field of the Invention

The invention relates to a grinding machine and a grinding method.

2. Description of the Related Art

Japanese Patent Application Publication No. 2000-218479 describes that, in external cylindrical grinding, the roundness of a workpiece is measured, a correction value is derived from a roundness error, and the workpiece is ground with a correction. In the case of grinding a crankpin, the degree of deflection of the crankpin varies because the stiffness of the crankpin varies depending on the rotational phase of a crankshaft. Therefore, Japanese Patent Application Publication No. 2000-107902 and Japanese Patent Application Publication No. 11-90800 each describe deriving a correction value based on the degree of deflection of a crankpin depending on the rotational phase a crankshaft and performing grinding with a correction. Thus, it is possible to achieve a high degree of accuracy of the roundness of the crankpin.

However, even if variations in the degree of deflection of the crankpin due to variations in the stiffness of the crankpin depending on the rotational phase of the crankshaft are taken into account, there is still room for improvement in the degree of accuracy of the roundness of the crankpin.

SUMMARY OF THE INVENTION

The invention is made in light of the above-described circumstances, and one object of the invention is to provide a grinding machine and a grinding method that make it possible to improve the degree of accuracy of the roundness of a workpiece.

The inventors diligently studied a cause of variations of a degree of deflection of a crankpin depending on the rotational phase of a crankshaft (hereinafter, simply referred to as "phase"), and found the fact that a coolant dynamic pressure and a grinding efficiency in addition to a stiffness of the crankpin vary depending on the phase. Thus, the inventors made the invention that makes it possible to achieve a high degree of accuracy of the roundness of the crankshaft.

An aspect of the invention relates to a grinding machine that grinds a workpiece by advancing and retracting a grinding wheel in synchronization with a rotational phase of the workpiece.

The grinding machine comprises:

a deflection degree acquisition unit that acquires a degree of deflection of an eccentric cylindrical portion of the workpiece during grinding based on a shape of the workpiece and a grinding condition, the eccentric cylindrical portion having a center offset from a rotation center of the workpiece, and a portion to be ground by the grinding wheel being the eccentric cylindrical portion;

a first correction value computing unit that computes a first correction value for a command position of the grinding wheel relative to the eccentric cylindrical portion based on the degree of deflection; and a command position correction unit that corrects the command position of the grinding wheel relative to the eccentric cylindrical portion based on the first correction value.

The effect of the above aspect will be described. The inventors found the fact that at least one of the coolant dynamic pressure and the grinding efficiency varies depending on the phase. In the case of grinding the eccentric cylindrical portion, the vertical position of a grinding point on the outer periphery of the grinding wheel varies depending on the phase. Therefore, the vertical position and the horizontal position of the grinding point relative to a coolant nozzle vary depending on the phase. As a result, the coolant dynamic pressure varies depending on the phase. In the case of grinding the eccentric cylindrical portion, the distance between the rotation center of the workpiece and the grinding point varies depending on the phase. Therefore, a circumferential velocity of the workpiece at the grinding point (hereinafter, simply referred to as "grinding point velocity") varies depending on the phase. The grinding efficiency is a value obtained by multiplying the grinding point velocity by a cut-in depth. Therefore, because the grinding point velocity varies depending on the phase, the grinding efficiency varies depending on the phase.

As described above, in the case of grinding the eccentric cylindrical portion, because at least one of the coolant dynamic pressure and the grinding efficiency varies depending on the phase, the degree of deflection of the eccentric cylindrical portion varies. The command position of the grinding wheel relative to the eccentric cylindrical portion is corrected with a first correction value computed based on the degree of deflection of the eccentric cylindrical portion. Therefore, it is possible to reduce a grinding error caused by variations of the coolant dynamic pressure and the grinding efficiency depending on the phase. That is, it is possible to achieve a high degree of accuracy of the roundness of the workpiece.

BRIEF DESCRIPTION OF THE DRAWINGS

The foregoing and further features and advantages of the invention will become apparent from the following description of example embodiments with reference to the accompanying drawings, wherein like numerals are used to represent like elements and wherein.

DETAILED DESCRIPTION OF EMBODIMENTS

Figure 1:
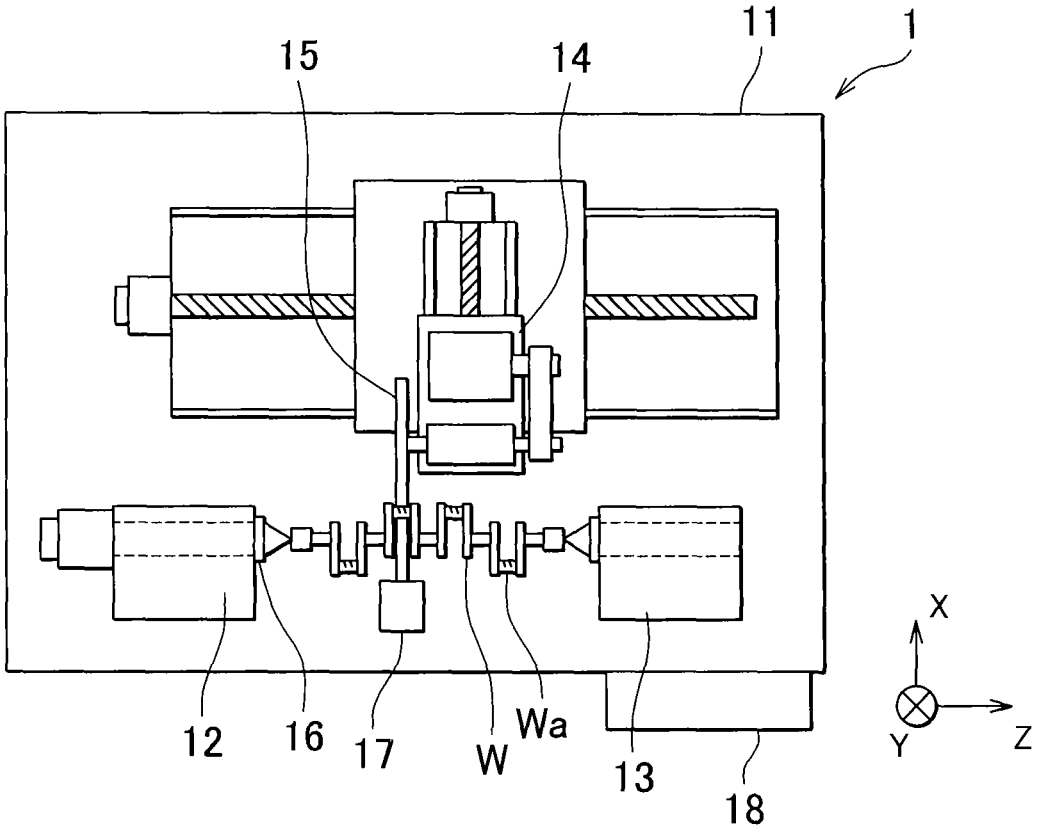
FIG. 1 is a plan view of a grinding machine according to an embodiment of the invention.

Hereinafter, a grinding machine and a grinding method according to an embodiment of the invention will be described. With reference to FIG. 1, a wheel head traversing-type external cylindrical grinding machine 1 will be described as an example of the above-mentioned grinding machine. A crankshaft W will be described as an example of a workpiece to be machined by the grinding machine 1, and a crankpin (eccentric cylindrical portion) Wa will be described as an example of a portion of the crankshaft W, which is to be ground. A recess such as an oil hole AA (illustrated in FIG. 2C) is formed in the crankpin Wa that is the portion to be ground. For example, the oil hole is extended through the crankpin Wa in the radial direction thereof.

The grinding machine 1 is configured as follows: A bed 11 is secured to a floor. A main spindle 12 and a tailstock 13, by which the crank shaft W is rotatably supported at its opposite ends, are mounted on the bed 11. The crankshaft W is supported by the main spindle 12 and the tailstock 13 so as to rotate about a journal. That is, the crankpin Wa, which is the portion to be ground, has a circular cross section of which the center is offset from a rotation center O of the crankshaft W. The main spindle 12 drives the crankshaft W to rotate the crankshaft W.

A grinding head 14 that is movable in a Z-axis direction and an X-axis direction is disposed on the bed 11. A grinding wheel 15 is rotatably supported by the grinding head 14, and the grinding head 14 is provided with a coolant nozzle 19 (illustrated in FIG. 2A) that supplies coolant toward a grinding point P. The main spindle 12 is provided with a force sensor 16 that measures an X-axis direction component force F (pressing force in the cut-in direction) that is applied to the main spindle 12. A sizing device 17 that measures the diameter of the crankpin Wa is disposed on the bed 11. The grinding machine 1 is provided with a controller 18 that rotates the main spindle 12 and the grinding wheel 15, and that controls the position of the grinding wheel 15 relative to the crankpin Wa.

The crankpin Wa that is the portion to be ground has a circular cross section of which the center is offset from the rotation center O of the crankshaft W. With reference to FIG. 2A to FIG. 2D, the position of the rotation center O of the crankshaft W and the position of a pin center Ow, which varies depending on a rotational phase θ (hereinafter referred to as "phase θ") of the crankshaft W, will be described. FIG. 2A to FIG. 2D are views that illustrate the crankpin Wa and the grinding wheel 15 as viewed in a direction from the negative side toward the positive side along the Z-axis in FIG. 1 (in a direction from the right side toward the left side in FIG. 1). FIG. 2A to FIG. 2D illustrate the crankshaft W in a state where deflection deformation of the crankshaft W has not occurred, and illustrate the coolant nozzle 19 and the grinding point P.

Figure 2A:
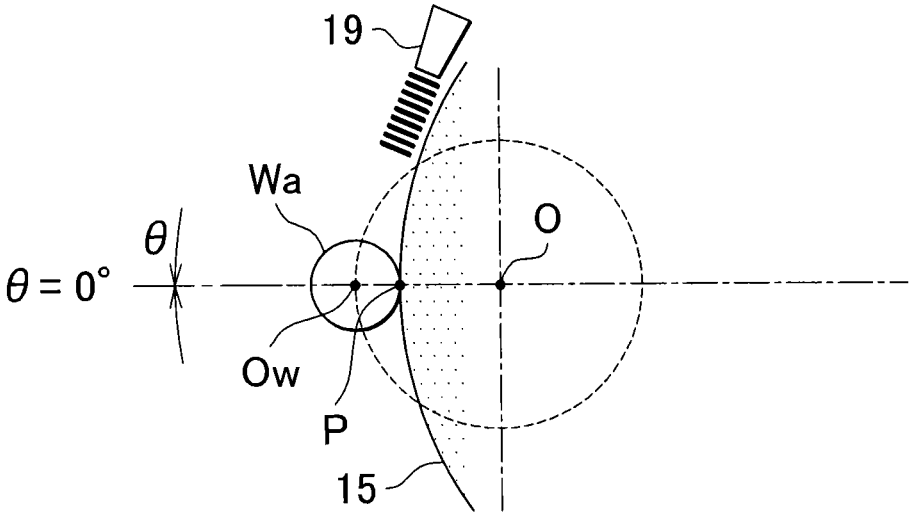
FIG. 2A is a view illustrating the positional relationship among a rotation center O of a crankshaft W, a pin center Ow of a crankpin Wa and a grinding wheel 15 when the phase of the crankshaft W is 0° in a state where the crankshaft W is not deflected.
Figure 2B:
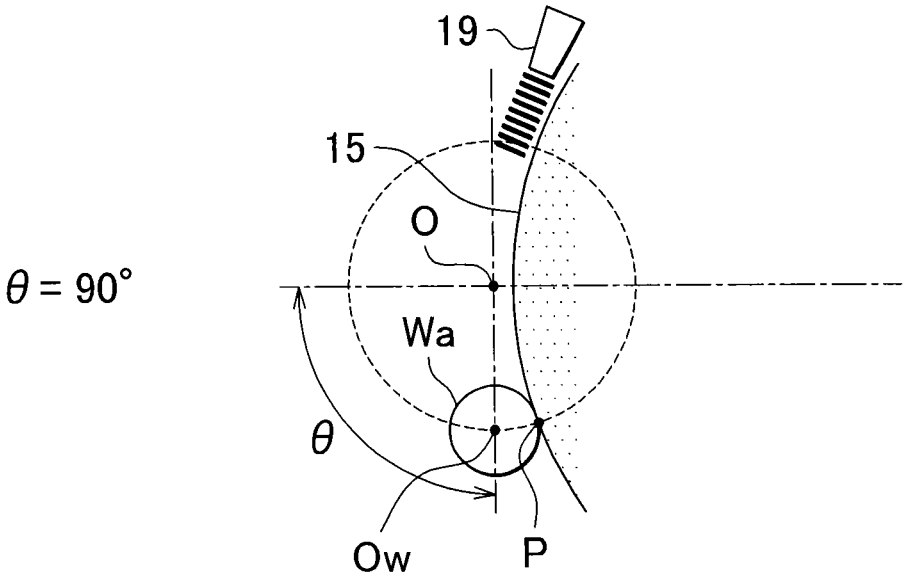
FIG. 2B is a view illustrating the positional relationship among the rotation center O of the crankshaft W, the pin center Ow of the crankpin Wa and the grinding wheel 15 when the phase of the crankshaft W is 90° in a state where the crankshaft W is not deflected.
Figure 2C:
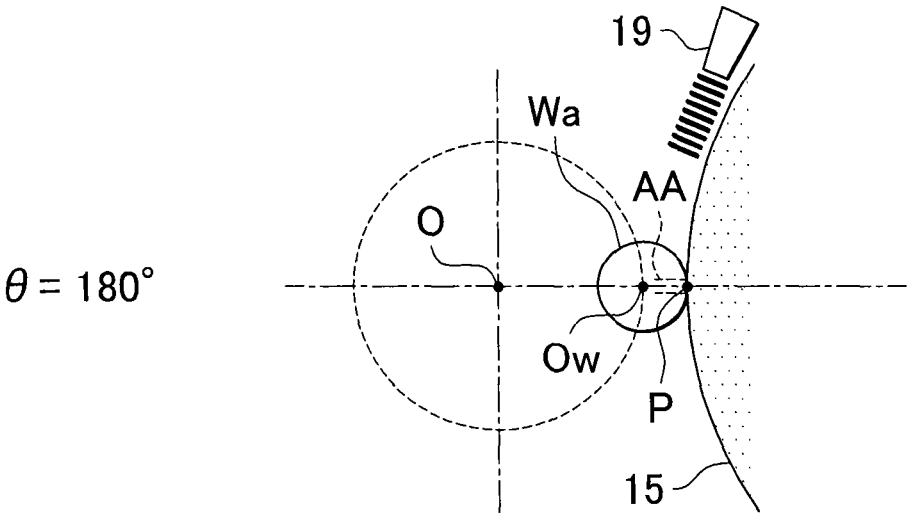
FIG. 2C is a view illustrating the positional relationship among the rotation center O of the crankshaft W, the pin center Ow of the crankpin Wa and the grinding wheel 15 when the phase of the crankshaft W is 180° in a state where the crankshaft W is not deflected.
Figure 2D:
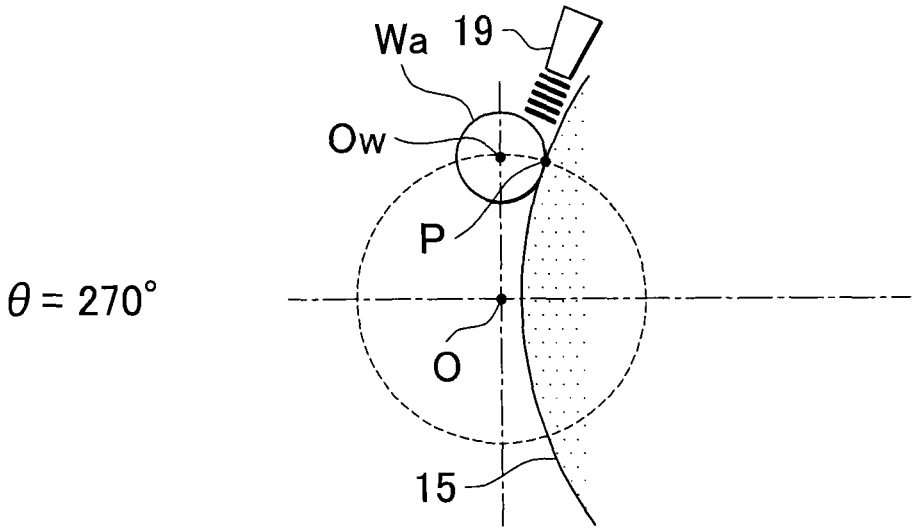
FIG. 2D is a view illustrating the positional relationship among the rotation center O of the crankshaft W, the pin center Ow of the crankpin Wa and the grinding wheel 15 when the phase of the crankshaft W is 270° in a state where the crankshaft W is not deflected.

When the phase θ is 0°, as illustrated in FIG. 2A, the pin center Ow is located at a position farther from the rotation center of the grinding head 14 than the rotation center O in the cut-in direction of the grinding wheel 15. The coolant is supplied toward the grinding point P from a position on the upper side of the grinding wheel 15. When the phase θ is 90°, as illustrated in FIG. 2B, the pin center Ow is located below the rotation center O. When the phase θ is 180°, as illustrated in FIG. 2C, the pin center Ow is located at a position closer to the grinding head 14 than the rotation center O. When the phase θ is 270°, as illustrated in FIG. 2D, the pin center Ow is located above the rotation center O.

Next, the grinding method according to the present embodiment will be briefly described with reference to FIG. 3. An X-axis average position Xave of the grinding wheel 15 represented by the ordinate axis in FIG. 13 is obtained by eliminating a periodical variation component of the X-axis position of the grinding wheel 15, caused by variations in the phase θ of the crankshaft W, from the X-axis position. In the present embodiment, the grinding method includes a rough grinding step, a finish grinding step and a spark-out step that are performed in this order. The coolant is supplied always during each of the grinding steps.

Figure 3:
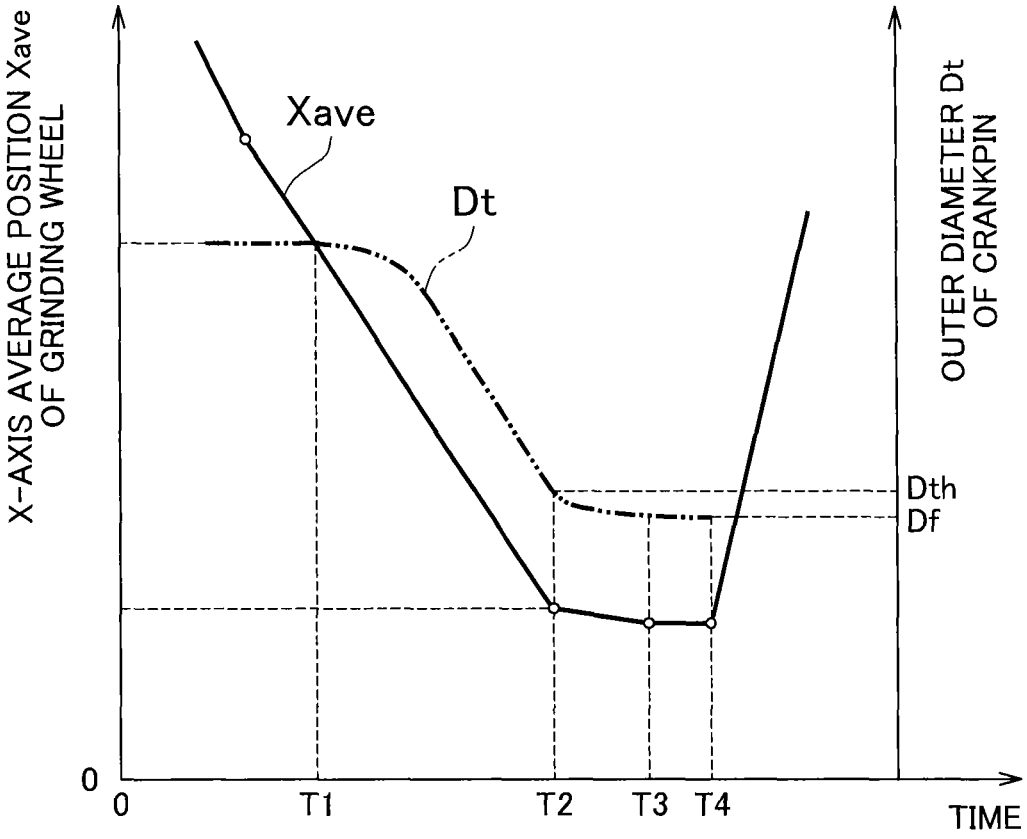
FIG. 3 is a graph illustrating temporal changes in an X-axis average position Xave of the grinding wheel 15 and an outer diameter Dt of the crank pin Wa to explain grinding steps.

First, the controller 18 advances the grinding wheel 15 relative to the crankshaft W in the X-axis direction to start rough grinding (rough grinding step performed from T1 to T2 on the abscissa axis in FIG. 3). During the rough grinding, the controller 18 controls the supply of the coolant such that the coolant is supplied to the grinding point P at a high flow rate.

In the rough grinding step, as illustrated in a region from T1 to T2 in FIG. 3, the grinding wheel 15 is advanced toward the negative side in the X-axis direction at a constant velocity. That is, in the rough grinding step, the grinding wheel 15 is moved relative to the crankpin Wa in such a direction that the grinding wheel 15 is pressed against the crankpin Wa. In the rough grinding step, in order to increase a grinding efficiency Z (the volume of a portion that is removed per unit time and per unit width), the moving velocity of the grinding wheel 15 is set higher than that in the finish grinding step. That is, in the region from T1 to T2 in FIG. 3, the rate of change in the X-axis average position Xave of the grinding wheel 15 is higher than that in the finish grinding step. During the rough grinding step, a coolant dynamic pressure Fp(θ) and a grinding force Fn(θ) act on the crankpin Wa, and the crankpin Wa is deflected in the cut-in direction.

During the rough grinding, the controller 18 determines whether an outer diameter Dt of the crankpin Wa, which is measured by the sizing device 17, has reached a predetermined value Dth. When the outer diameter Dt of the crankpin Wa has reached the predetermined value Dth, the step is changed from the rough grinding step to the finish grinding step (which is performed from T2 to T3 on the abscissa axis in FIG. 3).

In the finish grinding step, the controller 18 advances the grinding wheel 15 relative to the crankpin Wa (moves the grinding wheel 15 toward the negative side in the X-axis direction) to start the finish grinding. As illustrated in FIG. 3, the moving velocity (cut-in velocity) of the grinding wheel 15 is set lower in the finish grinding step than in the rough grinding step. Therefore, in the finish grinding step, grinding burn of the crankpin Wa is prevented from being caused. Further, by making the flow rate of the coolant that is supplied to the grinding point P low, it is possible to suppress variations in the coolant dynamic pressure Fp(θ) caused by the recess such as the oil hole AA and adverse effect on the degree of grinding accuracy due to the variations.

During the finish grinding, when the outer diameter Dt of the crankpin Wa, which is measured by the sizing device 17, has reached a finish diameter Df, the step is changed from the finish grinding step to the spark-out step. Spark-out is performed after the cut-in depth, by which the crankpin Wa is cut by the grinding wheel 15, is set to zero. That is, during the spark-out, a residual portion that should be removed but has not been removed during the finish grinding, is ground. The spark-out is performed during a predetermined number of rotations of the crankpin Wa. The spark-out is performed from T3 to T4 on the abscissa axis in FIG. 3.

Figure 4:
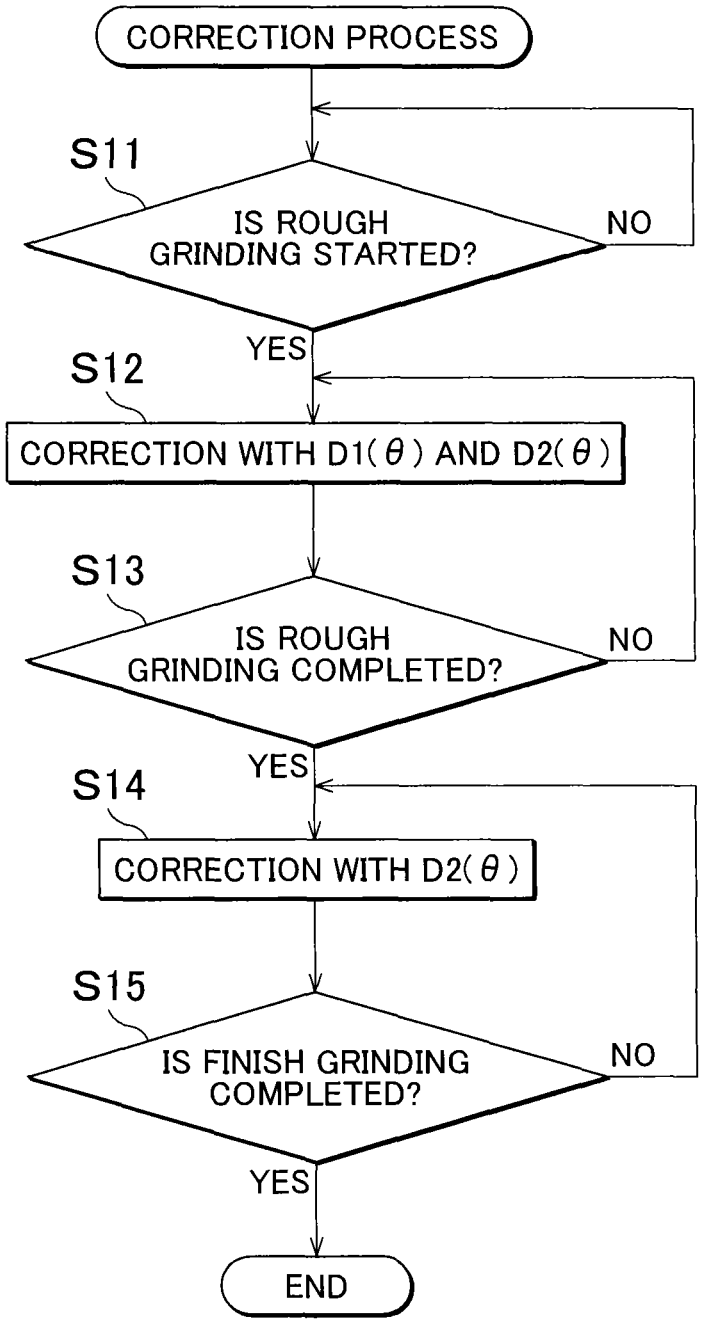
FIG. 4 is a flowchart of a correction process.

The controller 18 in the present embodiment executes a correction process described below to achieve a higher roundness of the crankpin Wa obtained through the grinding process. The correction process will be described with reference to a flowchart illustrated in FIG. 4.

When the rough grinding is started (YES in S11), a command position of the grinding wheel 15 relative to the crankpin Wa is corrected by a command position correction unit, with the use of a first correction value D1(θ) and a second correction value D2(θ) (S12). The first correction value D1(θ) is computed from a degree ϵ(θ) of deflection of the crankpin Wa, which varies depending on a pressing force F(θ) caused by the grinding. The second correction value D2(θ) is computed from a roundness error acquired by the roundness measurement. The details of the first correction value D1(θ) and the second correction value D2(θ) will be described later.

The correction is executed while the rough grinding is not completed (NO in S13). When the rough grinding is completed (YES in S13), the finish grinding is started as illustrated in FIG. 3. Then, correction of the command position of the grinding wheel 15 relative to the crankpin Wa is executed by the command position correction unit with the use of the second correction value D2(θ) (S14). The correction is executed while the finish grinding is not completed (NO in S15). Generally, the grinding force is lower in the finish grinding than in the rough grinding, and therefore the correction value differs between the finishing grinding and the rough grinding. Thus, during the finish grinding, correction with the use of the first correction value D1(θ) is not executed.

Next, a first correction value computing unit that computes the first correction value D1(θ) and the procedure for computing the first correction value D1(θ) will be described. The crankpin Wa undergoes deflection deformation in the cut-in direction (leftward direction in FIG. 2A to FIG. 2D) due to a pressing force F(θ) in the cut-in direction, which the crankpin Wa receives from the grinding wheel 15.

The pressing force F(θ) is the sum of the grinding force Fn(θ) and the coolant dynamic pressure Fp(θ) as expressed by the following formula (1).

$$F(\theta)=Fn(\theta)+Fp(\theta) \quad (1)$$

Namely, the degree ϵ(θ) of deflection of the crankpin Wa is the degree of deflection caused by the pressing force F(θ). A deflection degree acquisition unit and a method of acquiring the degree ϵ(θ) of deflection will be described below.

The first correction value D1(θ) is determined based on the degree ϵ(θ) of deflection. The degree ϵ(θ) of deflection varies depending on the phase θ of the crankshaft W. Thus, the first correction value D1(θ) is set to a value that varies depending on the phase θ of the crankshaft W. The procedure for computing the first correction value D1(θ) will be described below with reference to FIG. 5 to FIG. 11.

First, the grinding force Fn(θ) is computed. The grinding force Fn(θ) is expressed by the following formula (2), as a product of the grinding efficiency Z, a sharpness coefficient α of the grinding wheel 15 and a factor H of grinding width (hereinafter, referred to as "grinding width factor H"). The grinding width factor H will be described later.

$$Fn=Z\times\alpha\times H \quad (2)$$

Figure 5:
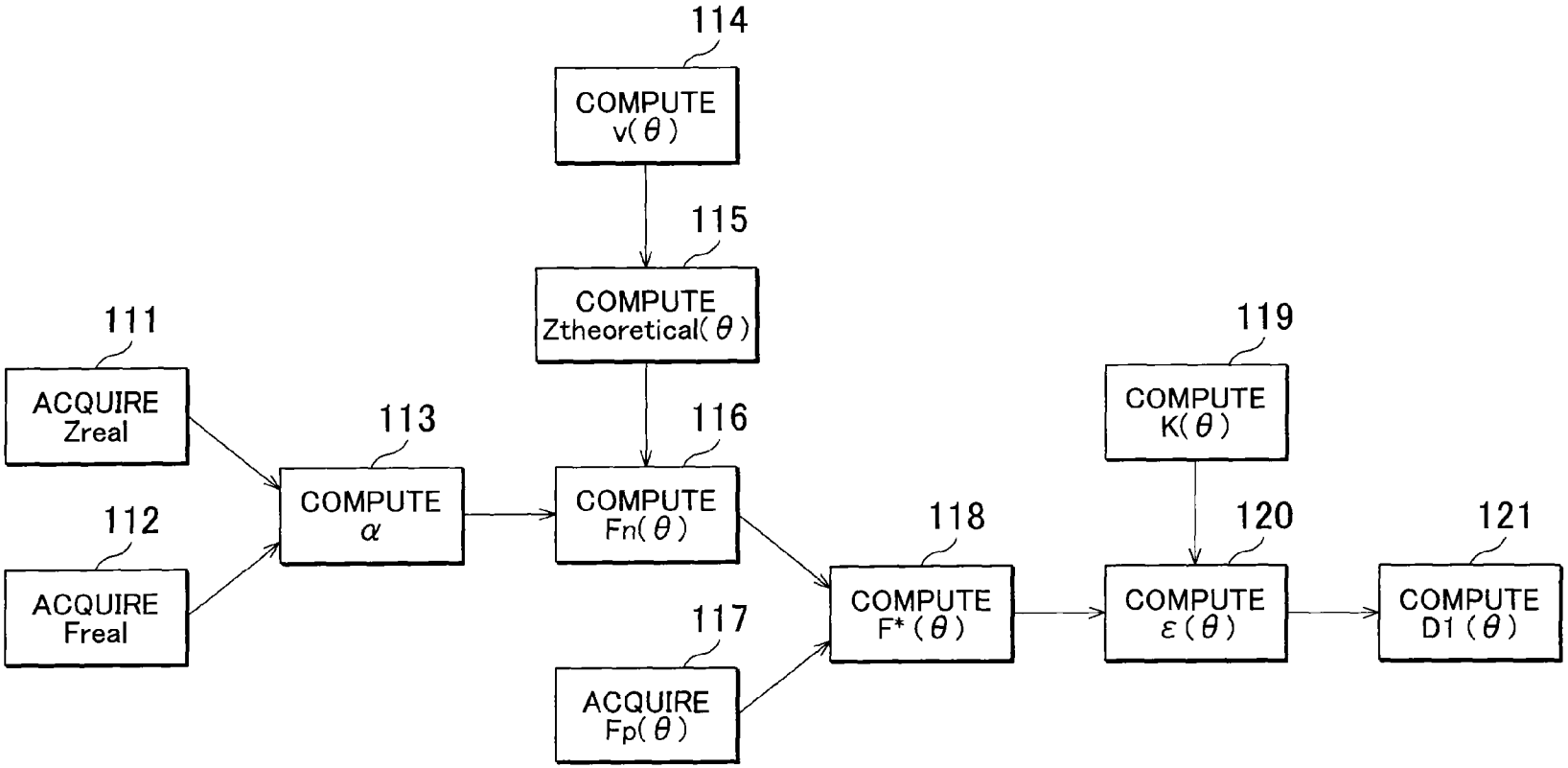
FIG. 5 is a block diagram illustrating the procedure for computing a first correction value D1(θ)

Therefore, during the rough grinding, a real grinding efficiency Zreal is acquired based on a cut-in depth d (process 111 in FIG. 5), and a real pressing force Freal is acquired based on a detection value obtained by the force sensor 16 (process 112 in FIG. 5). The grinding width at this stage is B0.

The grinding width factor H is a ratio of a grinding width B of the crankpin Wa to be ground according to the present embodiment, with respect to B0. The grinding width factor H can be derived from shapes of the crankpin Wa and the grinding wheel 15. The cut-in depth d can be derived from a grinding condition, or can be obtained through computation executed with the use of a signal from the sizing device 17.

Figure 6:
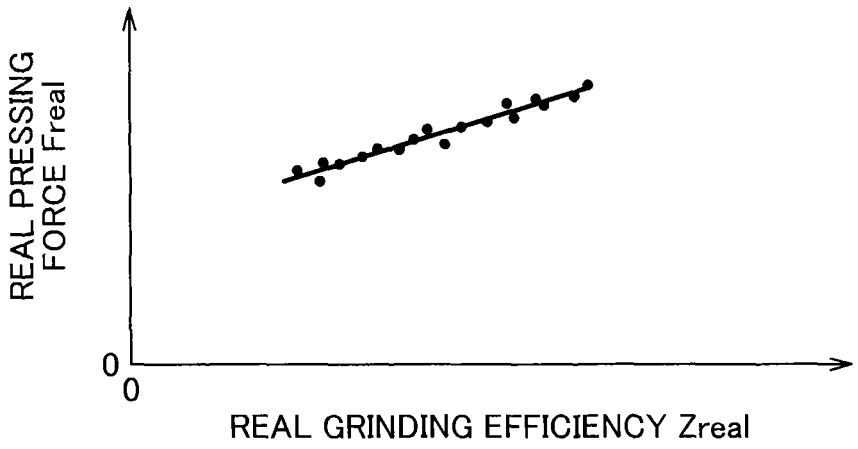
FIG. 6 is a graph illustrating the relationship between a real grinding efficiency Zreal and a real pressing force Freal in the cut-in direction, which the crankpin Wa receives from the grinding wheel 15.

Based on the relationships expressed by the formulae (1), (2), a slope of a graph illustrated in FIG. 6, in which the real grinding efficiency Z is represented by the abscissa axis and the real pressing force Freal is represented by the ordinate axis, indicates the product of the sharpness coefficient α and the grinding width factor H. That is, the sharpness coefficient α can be computed by obtaining the slope in FIG. 6 and dividing the slope by the grinding width factor H (process 113 in FIG. 5). The sharpness coefficient α expresses the relationship between the grinding force Fn and the grinding efficiency Z. The sharpness coefficient α varies depending on the condition of abrasive grain of the grinding wheel 15. Therefore, in the case of grinding many crankshafts W, the measurement is performed as needed during the grinding step to update the sharpness coefficient α.

Figure 7:
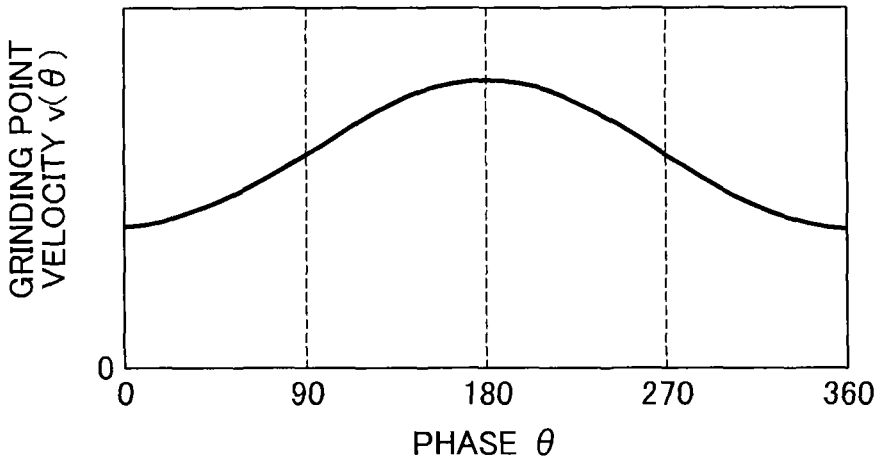
FIG. 7 is a graph illustrating a grinding point velocity v(θ) that varies depending on the phase θ of the crankshaft W.

Next, a grinding point velocity v(θ) is computed (process 114 in FIG. 5). The grinding point velocity v(θ) is a circumferential velocity of a workpiece at the grinding point P, and is proportional to a distance OP from the rotation center O to the grinding point P. As illustrated in FIG. 2A to FIG. 2D, the distance OP varies depending on the phase θ. Thus, as illustrated in FIG. 7, the grinding point velocity v(θ) varies depending on the phase θ. For example, when the phase θ is 180°, as illustrated in FIG. 2C, the grinding point P is farthest from the rotation center O. Therefore, as illustrated in FIG. 7, the grinding point velocity v(180°) is a high value. Thus, the grinding point velocity v(θ) can be geometrically computed from the shape of the crankshaft W and the grinding condition.

Next, a theoretical grinding efficiency Ztheoretical(θ) is computed from the grinding point velocity v(θ) (process 115 in FIG. 5). The theoretical grinding efficiency Ztheoretical(θ) can be obtained by multiplying the grinding point velocity v(θ) and the cut-in depth d, as expressed by the following formula (3). Note that an influence γ due to the recess is taken into account in the formula (3).

$$Ztheoretical(\theta)=d\times v(\theta)+\gamma \quad (3)$$

Figure 8:
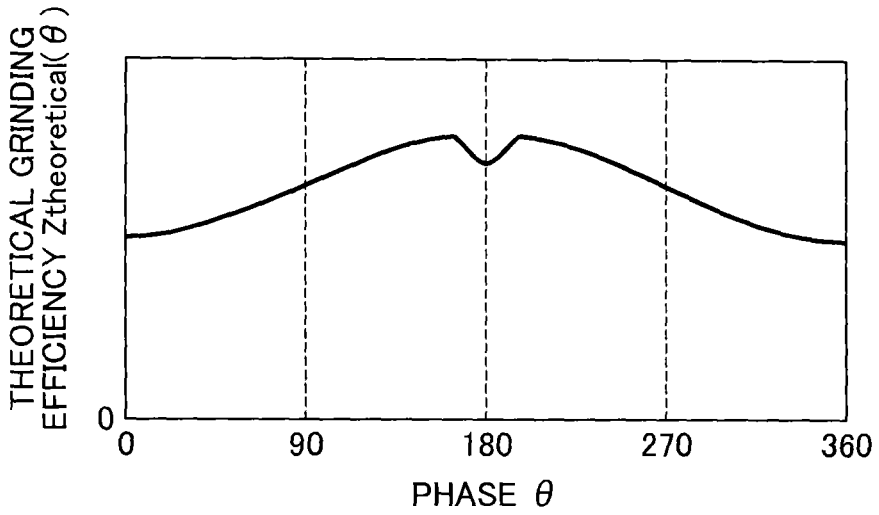
FIG. 8 is a graph illustrating a theoretical grinding efficiency Ztheoretical(θ) that varies depending on the phase θ of the crankshaft W.

The theoretical grinding efficiency Ztheoretical(θ) varies depending on the phase θ as illustrated in FIG. 8. An abrupt drop in the theoretical grinding efficiency Ztheoretical(θ), which is found around the phase θ of 180° in FIG. 8, is caused due to the influence γ of the recess.

Then, the grinding force Fn(θ) is computed based on the sharpness coefficient α, the theoretical grinding efficiency Ztheoretical(θ) and the grinding width factor H, according to the following formula (4) (process 116 in FIG. 5). The formula (4) is obtained by transforming the formula (2) into a function of the phase θ. The grinding force Fn(θ) varies depending on the phase θ as indicated by a two-dot chain line in FIG. 9.

$$Fn(\theta)=Ztheoretical(\theta)\times\alpha\times H \quad (4)$$

Subsequently, the coolant dynamic pressure Fp(θ) is acquired (process 117 in FIG. 5). The coolant dynamic pressure Fp(θ) corresponds to the real pressing force Freal (θ) in a condition in which the grinding force Fn(θ) is zero, that is, during the spark-out. Therefore, the coolant dynamic pressure Fp(θ) may be obtained during the spark-out that is performed after the finish grinding, or the coolant dynamic pressure Fp(θ) may be acquired by performing the spark-out immediately before the start of the rough grinding. The coolant dynamic pressure Fp(θ) varies depending on the phase θ as indicated by a broken line in FIG. 9.

The position of the grinding point P relative to the position of the coolant nozzle 19 varies depending on the phase θ, as illustrated in FIG. 2A to FIG. 2D. Therefore, the amount of the coolant that is supplied to the grinding point P varies depending on the phase θ. As a result, the coolant dynamic pressure Fp(θ) varies depending on the phase θ.

Figure 9:
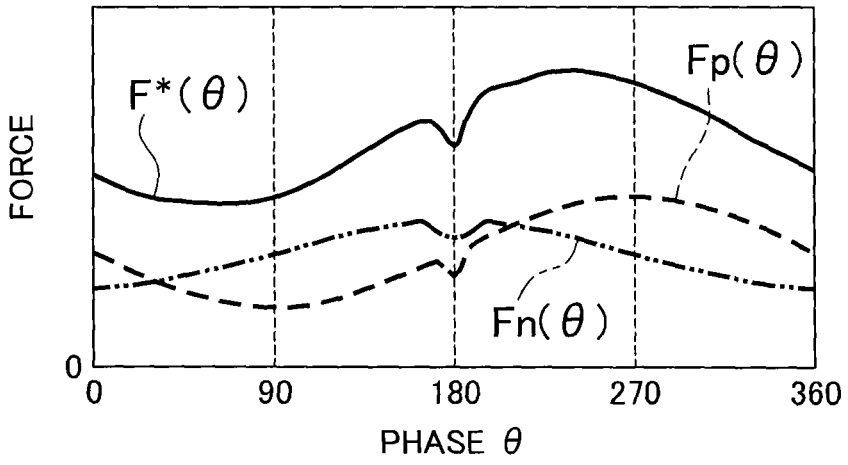
FIG. 9 is a graph illustrating a computed pressing force value F*(θ) in the cut-in direction, which the crank pin Wa receives from the grinding wheel 15, a grinding force Fn(θ), and a coolant dynamic pressure Fp(θ) that vary depending on the phase θ of the crankshaft W.

For example, as indicated by the broken line in FIG. 9, the coolant dynamic pressure Fp(90°) is lowest when the phase θ is 90° (refer to FIG. 2B). On the other hand, as indicated by the broken line in FIG. 9, the coolant dynamic pressure Fp(270°) is highest when the phase θ is 270° (refer to FIG. 2D). When the phase θ is 180°, the coolant dynamic pressure Fp(180°) is lower than the coolant dynamic pressures Fp(θ) that are found before and after the phase θ becomes 180°, due to influence of the oil hole AA.

The grinding force Fn(θ) and the coolant dynamic pressure Fp(θ) are both obtained. Thus, a computed pressing force value F*(θ), which is the sum of the grinding force Fn(θ) and the coolant dynamic pressure Fp(θ), is computed according to the formula (1) (process 118 in FIG. 5). The computed pressing force value F*(θ) varies depending on the phase θ as indicated by a bold line in FIG. 9. The computed pressing force value F*(θ) is highest when the phase θ is around 250°, whereas it is lowest when the phase θ is around 70°. The computed pressing force value F*(θ) drops when the phase θ is around 180° due to the influence of the oil hole AA.

Next, as illustrated in FIG. 5, a stiffness K(θ) in the cut-in direction, of the crankpin Wa is computed from the shape of the crankshaft W (process 119 in FIG. 5). The stiffness K(θ) may be computed based on a measured value, or may be acquired through analysis. The stiffness K(θ) varies depending on the phase θ.

Subsequently, the degree ϵ(θ) of deflection of the crankpin Wa depending on the computed pressing force value F*(θ) is computed from the computed pressing force value F*(θ) and the stiffness K(θ), according to the following formula (5) (process 120 in FIG. 5).

$$\epsilon(\theta)=F^*(\theta)/K(\theta) \quad (5)$$

Figure 10:
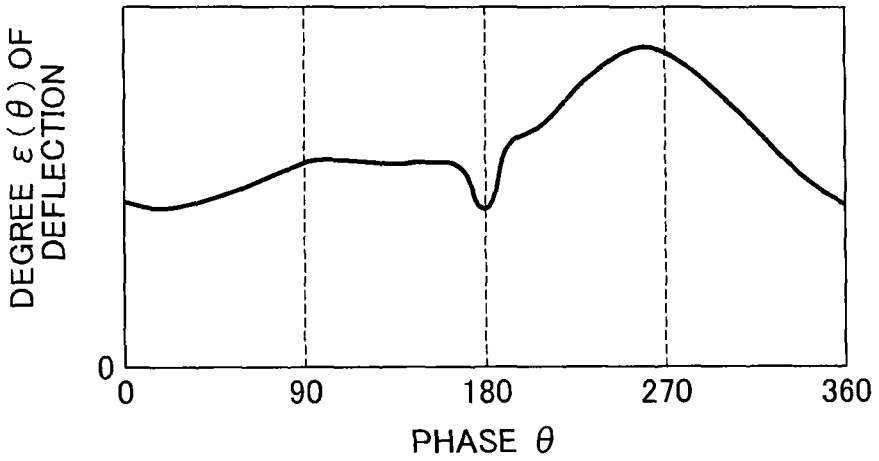
FIG. 10 is a graph illustrating a degree ϵ(θ) of deflection that varies depending on the phase θ of the crankshaft W.

The degree ϵ(θ) of deflection is obtained by dividing the computed pressing force value F*(θ) by the stiffness K(θ). The degree ϵ(θ) of deflection varies depending on the phase as illustrated in FIG. 10.

Figure 11:
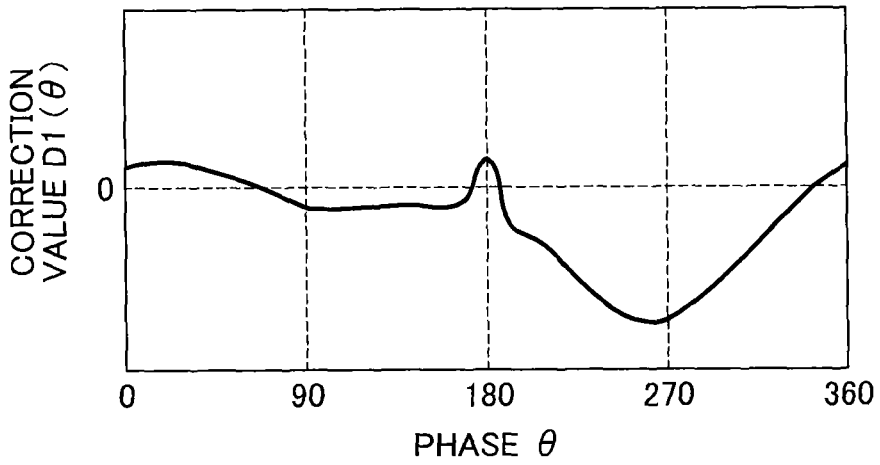
FIG. 11 is a graph illustrating the first correction value D1(θ) that varies depending on the phase θ of the crankshaft W.

Because the degree ϵ(θ) of deflection varies depending on the phase θ, the crankpin Wa after the grinding process has a roundness error. Therefore, the first correction value D1(θ) for reducing a roundness error due to the degree ϵ(θ) of deflection to zero, is computed (process 121 in FIG. 5) That is, the first correction value D1(θ) is determined so as to cancel out variations in a real cut-in depth, which is caused due to variations in the degree ϵ(θ) of deflection caused by the variations in the phase θ. The first correction value D1(θ) is derived as illustrated in FIG. 11. That is, the first correction value D1(θ) is derived in such a manner as to have a waveform of which the shape is obtained by vertically flipping the waveform of the degree ϵ(θ) of deflection with respect to the phase θ in FIG. 10.

By making a correction with the thus determined first correction value D1(θ), it is possible to reduce a grinding error caused due to variations in the coolant dynamic pressure Fp(θ) and the grinding efficiency Z (θ) depending on the phase θ. That is, it is possible to achieve a high degree of accuracy of the roundness of the crankpin Wa.

The correction with the first correction value D1(θ) is executed during the rough grinding step, as described above with reference to FIG. 4. By executing the correction with the first correction value D1(θ) during the rough grinding, it is possible to achieve a high degree of accuracy of the roundness of the crankpin Wa when the rough grinding is completed. Meanwhile, a grinding allowance in the finish grinding is considerably smaller than a grinding allowance in the rough grinding. Further, the amount of coolant supplied during the finish grinding is smaller than the amount of coolant supplied during the rough grinding. In view of these facts, the degree ϵ(θ) of deflection of the crankpin Wa in the finish grinding is lower than the degree ϵ(θ) of deflection of the crankpin Wa in the rough grinding.

Therefore, according to another embodiment of the invention, the above-described correction is executed during the rough grinding, whereas it is not executed during the finish grinding. Even if the above-described correction is not executed during the finish grinding, it is possible to achieve a high degree of accuracy of the roundness of the crankpin Wa after the finish grinding.

Figure 12:
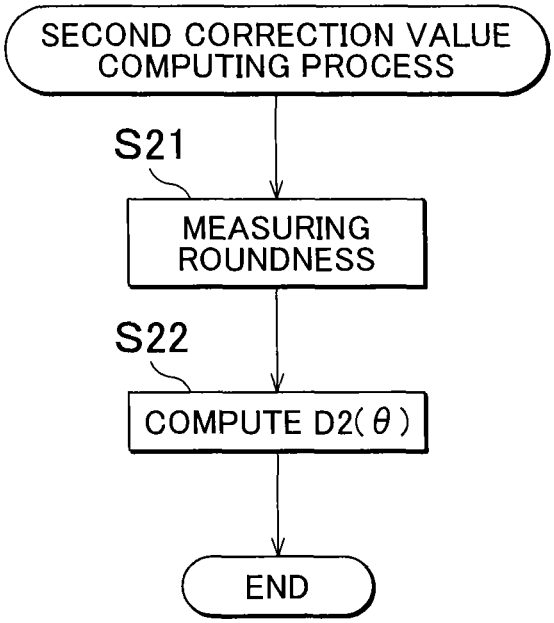
FIG. 12 is a flowchart illustrating the procedure for computing a second correction value D2(θ).

Next, a second correction value computing unit that computes the second correction value D2 (θ) and the procedure for computing the second correction value D2(θ) will be described with reference to a flowchart illustrated in FIG. 12. In order to compute the second correction value D2(θ), the roundness of the crankpin Wa that has actually undergone the grinding process is measured (step S21) to acquire a roundness error. Then, the second correction value D2(θ) for reducing the roundness error to zero is computed (step S22). By executing a correction with the thus computed second correction value D2(θ), it is possible to achieved a higher degree of accuracy of the roundness of the crankpin Wa.

In the rough grinding step in the above embodiments, the correction with the first correction value D1 and the correction with the second correction value D2 are simultaneously executed. By executing the correction with the second correction value D2 in combination with the correction with the first correction value D1, roundness errors due to the influences other than the influence of the degree ϵ(θ) of deflection and a roundness error due to an error caused by computing the degree $\epsilon(\theta)$ of deflection can be eliminated. Further, according to yet another embodiment of the invention, only the first correction value D1(θ) is used during the rough grinding step. Even in the case where only the first correction value D1 is used, it is possible to produce a sufficient effect of reducing a roundness error.

What is claimed is:

1. A grinding machine that grinds a workpiece by advancing and retracting a grinding wheel in synchronization with a rotational phase of the workpiece, comprising:

a deflection degree acquisition unit that acquires a degree of deflection of an eccentric cylindrical portion of the workpiece during grinding based on a shape of the workpiece and a grinding condition, the eccentric cylindrical portion having a center offset from a rotation center of the workpiece, and a portion to be ground by the grinding wheel being the eccentric cylindrical portion;

a first correction value computing unit that computes a first correction value for a command position of the grinding wheel relative to the eccentric cylindrical portion based on the degree of deflection; and a command position correction unit that corrects the command position of the grinding wheel relative to the eccentric cylindrical portion based on the first correction value, wherein the deflection degree acquisition unit comprises:

a unit that computes a theoretical grinding efficiency by multiplying a grinding point velocity by a cut-in depth based on the shape of the workpiece and the grinding condition;

a unit that acquires a real grinding efficiency during grinding;

a unit that acquires a real pressing force in a cut-in direction, the eccentric cylindrical portion receiving the real pressing force from the grinding wheel during grinding;

a unit that computes a sharpness coefficient that expresses a relationship between the real grinding efficiency and the real pressing force based on the acquired real grinding efficiency and the acquired real pressing force;

a unit that computes a grinding force based on the theoretical grinding efficiency and the sharpness coefficient;

a unit that acquires the real pressing force during spark-out, as a coolant dynamic pressure;

a unit that computes a computed pressing force value that is a sum of the grinding force and the coolant dynamic pressure;

a unit that acquires a stiffness of the workpiece; and a unit that computes the degree of deflection of the workpiece by dividing the computed pressing force value by the stiffness of the workpiece.

2. The grinding machine according to claim 1, wherein:

the unit that acquires the stiffness is configured to acquire stiffness that varies depending on the phase of the workpiece; and the unit that computes the degree of deflection is configured to compute a degree of deflection that varies depending on the phase of the workpiece by dividing the computed pressing force value by the stiffness.

3. The grinding machine according to claim 1, wherein, in the case of performing finish grinding after rough grinding, the command position correction unit corrects the command position of the grinding wheel relative to the eccentric cylindrical portion based on the first correction value during the rough grinding, but does not execute correction of the command position of the grinding wheel relative to the eccentric cylindrical portion based on the first correction value during the finish grinding.

4. The grinding machine according to claim 2, wherein, in the case of performing finish grinding after rough grinding, the command position correction unit corrects the command position of the grinding wheel relative to the eccentric cylindrical portion based on the first correction value during the rough grinding, but does not execute correction of the command position of the grinding wheel relative to the eccentric cylindrical portion based on the first correction value during the finish grinding.

5. The grinding machine according to claim 3, further comprising:

a unit that measures a roundness of the eccentric cylindrical portion after grinding; and a second correction value computing unit that computes a second correction value for the command position of the grinding wheel relative to the eccentric cylindrical portion based on the roundness, wherein the command position correction unit corrects the command position of the grinding wheel relative to the eccentric cylindrical portion based on both the first correction value and the second correction value during the rough grinding, and corrects the command position of the grinding wheel relative to the eccentric cylindrical portion based on the second correction value during the finish grinding.

6. The grinding machine according to claim 4, further comprising:

a unit that measures a roundness of the eccentric cylindrical portion after grinding; and a second correction value computing unit that computes a second correction value for the command position of the grinding wheel relative to the eccentric cylindrical portion based on the roundness, wherein the command position correction unit corrects the command position of the grinding wheel relative to the eccentric cylindrical portion based on both the first correction value and the second correction value during the rough grinding, and corrects the command position of the grinding wheel relative to the eccentric cylindrical portion based on the second correction value during the finish grinding.

7. A grinding method of grinding a workpiece by advancing and retracting a grinding wheel in synchronization with a rotational phase of the workpiece, comprising:

acquiring, using a deflection degree acquisition unit, a degree of deflection of an eccentric cylindrical portion of the workpiece during grinding based on a shape of the workpiece and a grinding condition, the eccentric cylindrical portion having a center offset from a rotation center of the workpiece, and a portion to be ground by the grinding wheel being the eccentric cylindrical portion;

computing, in a first correction value computing unit, a first correction value for a command position of the grinding wheel relative to the eccentric cylindrical portion based on the degree of deflection; and correcting, in a command position correction unit, the command position of the grinding wheel relative to the eccentric cylindrical portion based on the first correction value, wherein the step of acquiring a degree of deflection of an eccentric cylindrical portion of the workpiece comprises:

computing a theoretical grinding efficiency by multiplying a grinding point velocity by a cut-in depth based on the shape of the workpiece and the grinding condition;

acquiring a real grinding efficiency during grinding;

acquiring a real pressing force in a cut-in direction, the eccentric cylindrical portion receiving the real pressing force from the grinding wheel during grinding;

computing a sharpness coefficient that expresses a relationship between the real grinding efficiency and the real pressing force based on the acquired real grinding efficiency and the acquired real pressing force;

computing a grinding force based on the theoretical grinding efficiency and the sharpness coefficient;

acquiring the real pressing force during spark-out, as a coolant dynamic pressure;

computing a computed pressing force value that is a sum of the grinding force and the coolant dynamic pressure;

acquiring a stiffness of the workpiece; and computing the degree of deflection of the workpiece by dividing the computed pressing force value by the stiffness of the workpiece.

* * * * *